US005973418A

United States Patent [19]

Ciesielka et al.

[11] Patent Number: 5,973,418

[45] Date of Patent: Oct. 26, 1999

[54] PULL-OUT HIGH CURRENT SWITCH

[75] Inventors: Sean V. Ciesielka, Mundelein, Ill.; B. Heath Scoggin, Wildwood; Jaime A. Torrez, Chesterfield, both of Mo.

[73] Assignee: Cooper Technologies Company, Houston, Tex.

[21] Appl. No.: 09/072,450

[22] Filed: May 5, 1998

[51] Int. Cl.[6] ..... H01H 35/00

[52] U.S. Cl. ..... 307/130; 307/112; 307/116; 340/635; 340/660

[58] Field of Search ..... 307/112, 116, 307/125, 130, 131, 149; 315/88, 93, 129, 130, 136; 340/500, 522, 540, 635, 652, 657, 660, 638, 639; 361/835; 337/1, 4, 5, 9, 142, 186, 208

[56] References Cited

U.S. PATENT DOCUMENTS

| | | | |
|---|---|---|---|
| 2,091,204 | 8/1937 | Horn . | |
| 3,139,499 | 6/1964 | Cosgrove . | |
| 3,272,947 | 9/1966 | Kobryner . | |
| 3,418,615 | 12/1968 | Canney . | |
| 3,729,656 | 4/1973 | Luquain | 361/104 |
| 3,745,546 | 7/1973 | Struger et al. | 340/250 |
| 3,828,290 | 8/1974 | Kawiecki . | |
| 4,302,643 | 11/1981 | Cox et al. | 200/144 |
| 4,380,718 | 4/1983 | Miller | 307/10.1 |
| 4,429,936 | 2/1984 | Rusenko . | |
| 4,536,046 | 8/1985 | Erickson . | |
| 4,691,197 | 9/1987 | Damiano et al. | 340/638 |
| 4,966,561 | 10/1990 | Norden . | |
| 5,186,637 | 2/1993 | Norden . | |
| 5,233,330 | 8/1993 | Hase | 340/638 |
| 5,534,842 | 7/1996 | Nagayama et al. | 337/402 |
| 5,559,489 | 9/1996 | Weiden | 337/215 |
| 5,633,619 | 5/1997 | Oetjen et al. | 337/143 |
| 5,670,929 | 9/1997 | Totsuka . | |
| 5,825,274 | 10/1998 | Totsuka | 337/190 |
| 5,835,002 | 11/1998 | Barnett | 337/143 |

*Primary Examiner*—Jeffrey Gaffin
*Assistant Examiner*—Peter Zura
*Attorney, Agent, or Firm*—Armstrong Teasdale LLP

[57] ABSTRACT

A high-current fusible switch includes a nonconductive base, a nonconductive removable top, a plurality of conductive fuse clips, and a fuse having blade-type terminals. The fuse clips are fixedly mounted within the base. The fuse is retained within the top. Switching is accomplished by inserting or removing the top so that the fuse completes or breaks the circuit to which the switch is connected. The switch is connected to the circuit directly at the fuse clips so that a compact design is achieved that eliminates undesirable multiple electrical contacts.

23 Claims, 11 Drawing Sheets

PULL-OUT HIGH CURRENT SWITCH

BACKGROUND OF THE INVENTION

1. Field of the Invention

The present invention relates to switches generally. In particular, it relates to pull-out fusible switches having the ability to interrupt high-current DC circuits by extraction of a fuse.

2. Related Art

Switches that are capable of interrupting high-current DC circuits are utilized in numerous environments. One such use is in the telecommunications industry. The DC side of a telecommunications power plant often includes circuits attached to high amp-hour battery strings that provide back-up DC power. Switches that operate in such circuits are often required to withstand up to 100,000 Amps of short-circuit current.

DC switches previously used in such applications had power fuses that were bolted inside the switch. Replacement of a blown fuse in such a device requires the use of metal tools, such as wrenches, to loosen the nuts that secure the fuse to the switch. The potential for a metallic tool or a piece of metallic hardware coming into contact with a copper busway, rectifier, or battery compartment poses the risk of causing the equipment to short-circuit. Existing DC switches are also bulky, complicated, and expensive.

U.S. Pat. No. 3,418,615 to Canney discloses a removable fuse holder for converting unfused transformers into fused transformers. The fuse holder of Canney includes a fuse container with a cover member that fits on the container. The cover includes a pair of fuse brackets that carry a pair of cylindrical fuses. The relatively thin ferrule-type terminals of the cylindrical fuses are not well suited for the frictional wear associated with repeated removal of the fuse from the fuse clips while switching. A pair of fuse clips are mounted to each compartment of the fuse container. One fuse clip has a bar-like projection that extends out through a side surface of the container for electrical connection to a terminal of a transformer. The other fuse clip has terminal member that also projects out through a side surface of the container. The additional bar member and terminal member represent additional electrical contacts. Additional electrical contacts are disadvantageous because they result in increased resistance and the associated increase in operating temperature, as well as higher voltage drops (or watt losses).

U.S. Pat. No. 4,536,046 to Erickson discloses a pull-out fusible switch for use in circuit-breaker boxes. The switch includes a base and removable cover. The base includes terminal contacts that extend out of the side of the base. Fuse clips are mounted to the base and are used to retain cylindrical fuse elements. The fuses are mounted within the base member and remain within the base when the cover is removed. The cover has a downwardly extending blade that makes an electrical connection with the base. Separate bar-like members provide an electrical connection between the fuse clips and the side terminals. As noted above, these additional electrical contacts are not desirable.

U.S. Pat. No. 3,139,499 to Cosgrove discloses a fuse adapter capable of replacing circuit breakers. The adapter has a body with a removable cover. The cover includes fuse clips that carry a cylindrical fuse element. The cover also has a lamp that indicates whether a fuse has blown. Separate electrical contacts are mounted to the base and electrically connect the fuse to terminals via wire leads.

U.S. Pat. No. 2,091,204 to Horn discloses a fuse box that can be inserted into a three-phase power supply to an electric power tool. The fuse box includes a base and a removable top. The top has a fuse carrier clip member that carries a cylindrical fuse. The fuse is electrically connected to side terminals by separate U-shaped contact clips and a bar-like member screwed to each contact clip.

U.S. Pat. No. 3,272,947 to Kobryner discloses a pull-out switch arrangement. The switch has a tub or base and a puller or top. The top has fuse clips that retain the terminals of a fuse member. Separate flange and bus bar fingers are screwed to the base and electrically connect the fuse to the bus bar when the top is inserted into the base. Once again, the additional electrical contacts formed by this construction results in increased resistance and the associated increase in operation temperature, as well as high voltage drops (or watt losses).

U.S. Pat. Nos. 4,966,561 and 5,186,637 to Norden each discloses a fuse holder having a receptacle and a fuse carrier. Separation of the fuse carrier from the base is facilitated by a cam-action lever. The fuse carrier has a pair of terminal brackets that contact the ends of a cylindrical fuse element. A separate U-shaped contact is screwed to the terminal brackets. Each leg of the U-shaped contact is held by a pair of contact fingers which are mounted to the receptacle, thereby electrically connecting the fuse to the receptacle by multiple electrical contacts. A separate clamp member receives an electrical connector inserted through an aperture in the side of the receptacle. The resulting construction is complicated and has multiple electrical connections.

OBJECTS AND SUMMARY

It is an object of the present invention to provide a compact, high-current fusible switch which has the ability to interrupt high-current circuits by extraction of a fuse member without the use of tools.

To achieve this, as well as other objectives, a pull-out fusible switch of the present invention may include an electrically nonconductive base, an electrically nonconductive removable top having a fuse carrier, a fuse having a fuse body and blade-type terminals projecting from opposite ends of the fuse body mounted within the fuse carrier, and electrically conductive fuse clips mounted within the base. The fuse clips are adapted to receive the blade-type terminals.

A switch constructed according to the principles of the present invention may also include an electrically nonconductive base, an electrically nonconductive removable top having a fuse carrier, and at least one electrically conductive fuse clip mounted within the base. At least one aperture is disposed in the base. The at least one fuse clip being mounted in the aperture so that a surface of the fuse clip is located within the aperture and provides a site for direct electrical connection.

DETAILED DESCRIPTION OF THE PREFERRED EMBODIMENTS

Figure 1:
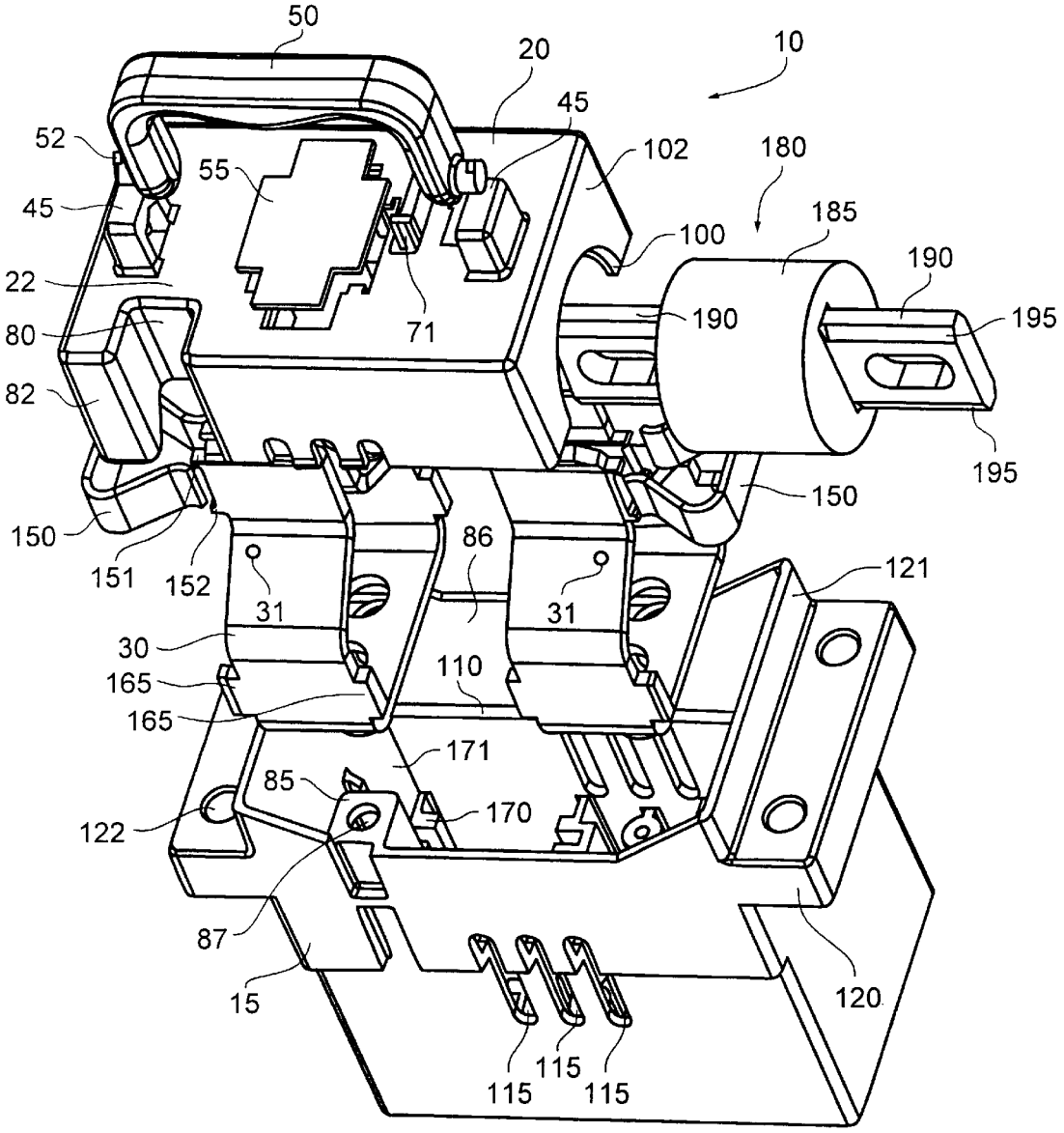
FIG. 1 is an exploded perspective view of a switch according to the present invention.

The invention will now be described by reference to the drawing Figures. The same reference numerals have been used throughout the drawings to identify the same elements.

Figure 3:
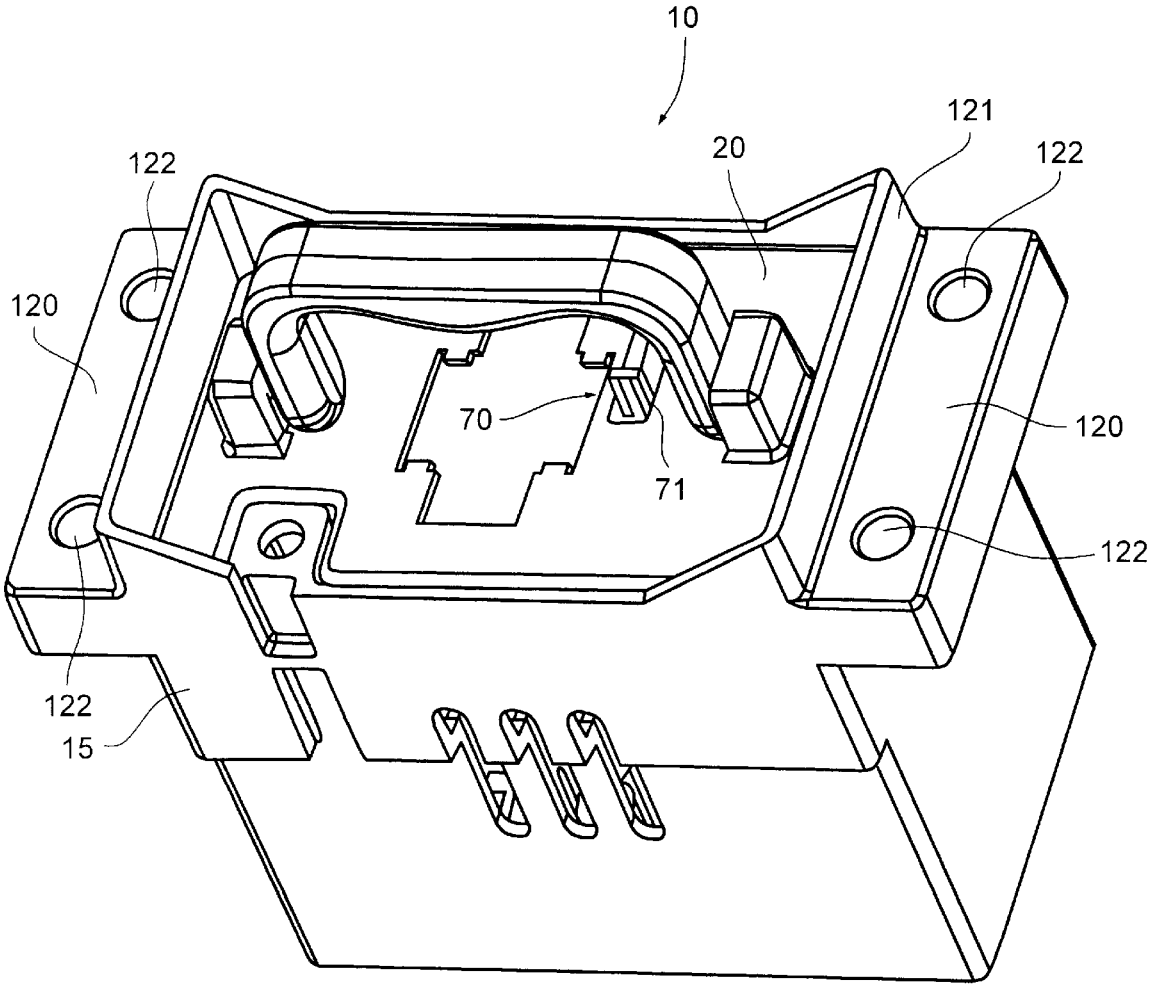
FIG. 3 is a perspective view of the switch of claim 1 in an assembled operative condition.

A switch constructed according to the principles of the present invention is shown generally at 10, and is best illustrated in FIGS. 1 and 3. The main components of the switch 10 include an electrically nonconductive base 15, an electrically nonconductive top 20, electrically conductive fuse clips 30, and a fuse 180. The top 20 is removably received 20 within the base 15. The fuse clips 30 are fixedly mounted within the base 15, and the fuse 180 is mounted within the top 20. The switch 10 is electrically connected to a circuit (not shown) via the fuse clips 30. As will be explained more filly below, the switch is "turned off", and the circuit is broken, by separating the top 20 (along with the fuse 180) from the base 15.

The top 20 is a generally rectangular member. The top 20 can be formed of any suitable nonconductive material. Preferably, the material is a moldable plastic. The top 20 has a horizontal exterior planar surface 22 with a transparent window 55 formed therein. Window 55 permits visual inspection of the fuse 180.

Hinges 45 are also provided on the surface 22. A handle 50 is pivotably mounted within the hinges 45. A projection 52 helps retain the handle 50 within the hinges 45.

A guide slot 80 is formed along a vertical exterior surface 82 on the top 20. As illustrated in FIGS. 1 and 3, guide slot 80 is disposed on the top 20. The guide slot 80 receives a guide projection 85 located on the base when the top 20 is properly inserted into the base 15.

Figure 6:
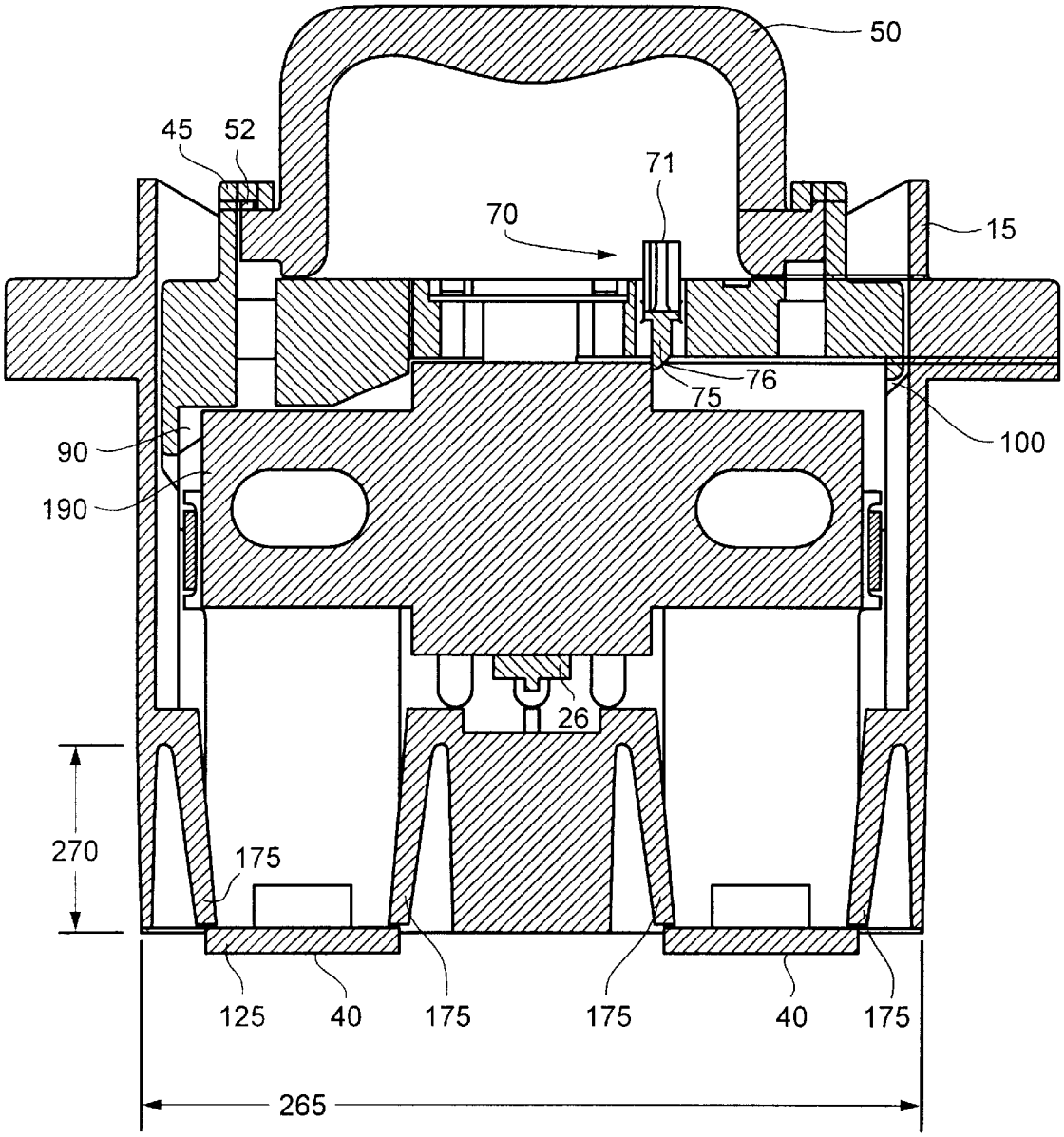
FIG. 6 is a cross-sectional view taken along line 6—6 of FIG. 5.
Figure 7:
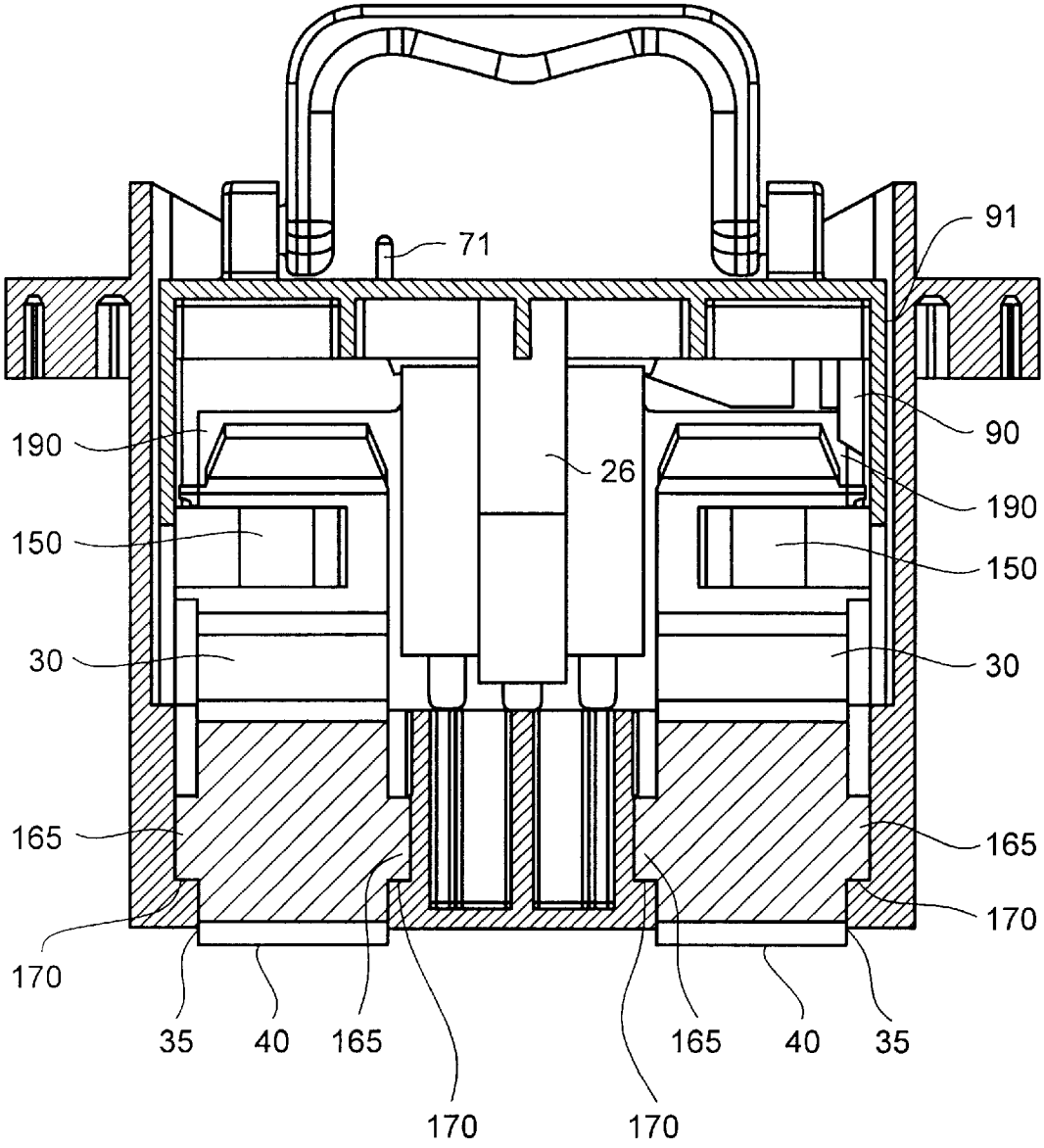
FIG. 7 is a cross-sectional view taken along line 7—7 of FIG. 5.

An arcuate recess 100 is formed in a vertical end surface 102 of the top 20. The arcuate recess 100 is dimensioned to accommodate a cylindrical body 185 of the fuse 180. As shown in FIGS. 6 and 7, the opposite end of the top 20 lacks such a recess. Instead, fuse terminal guides 90 are provided along interior vertical surface 91. A male blade-type terminals 190 is received between terminal guides 90 when a fuse 180 is inserted into the housing. This construction permits insertion and removal of the fuse 180 only through the end of the top 20 having recess 100. The terminal end of the fuse 180 which is first inserted is received by the guides 90.

The top 20 also includes a structure 25 for carrying the fuse 180. This structure 25 can be seen in FIG. 2 and includes a generally circular carrier ring 26. Carrier ring 26 receives the cylindrical fuse body 185 therein. Carrier ring 26 may be a separate member affixed to the top 20, or it may be integrally formed with the top 20 in a one-piece construction. Once received within the carrier ring 26, the fuse 180 is coupled with the top 20 so that removal of the top 20 from the base 15 also results in removal of the fuse 180 from the base 15.

The fuse is kept from sliding out of the recess 100 by a release lever 70, which is best illustrated in FIG. 6. The release lever 70 includes a release tab 71 and a retaining projection 75. Upon insertion of the fuse 180 into the carrier ring 26, one end of the fuse body 185 engages a ramping surface 76 disposed on the retaining tab 75, causing the release lever structure 70 to pivot up and allowing the body 185 of the fuse 180 to pass therethrough. Once the fuse 180 is fully inserted, the release lever 70 returns to the position shown in FIG. 6. The retaining projection 75 is then in engagement with an end surface of the fuse body 185 thereby preventing the fuse 180 from falling out of the top through recess 100. In order to remove the fuse 180 from the top 20, the release tab 71 is urged in the direction of arrow A (see FIG. 5), causing the release lever 70 to pivot up to a position where a clearance is created between the retaining projection 75 and the fuse body 185. The fuse can then be removed from the top 20 through recess 100.

The fuse 180 may have a generally cylindrical body 185 with male blade-type terminals 190 at opposite ends thereof. The blade-type terminals 190 can be chamfered as shown at 195 in order to facilitate installation and removal of fuse 180 from the base. Male blade-type terminals 190 are preferred since their substantial cross-section-sectional dimensions are not easily damaged or worn by the repeated insertion and removal of the fuse associated with the "switching" function. By contrast, relatively thin ferrule-type terminals may be easily damaged.

Figure 4:
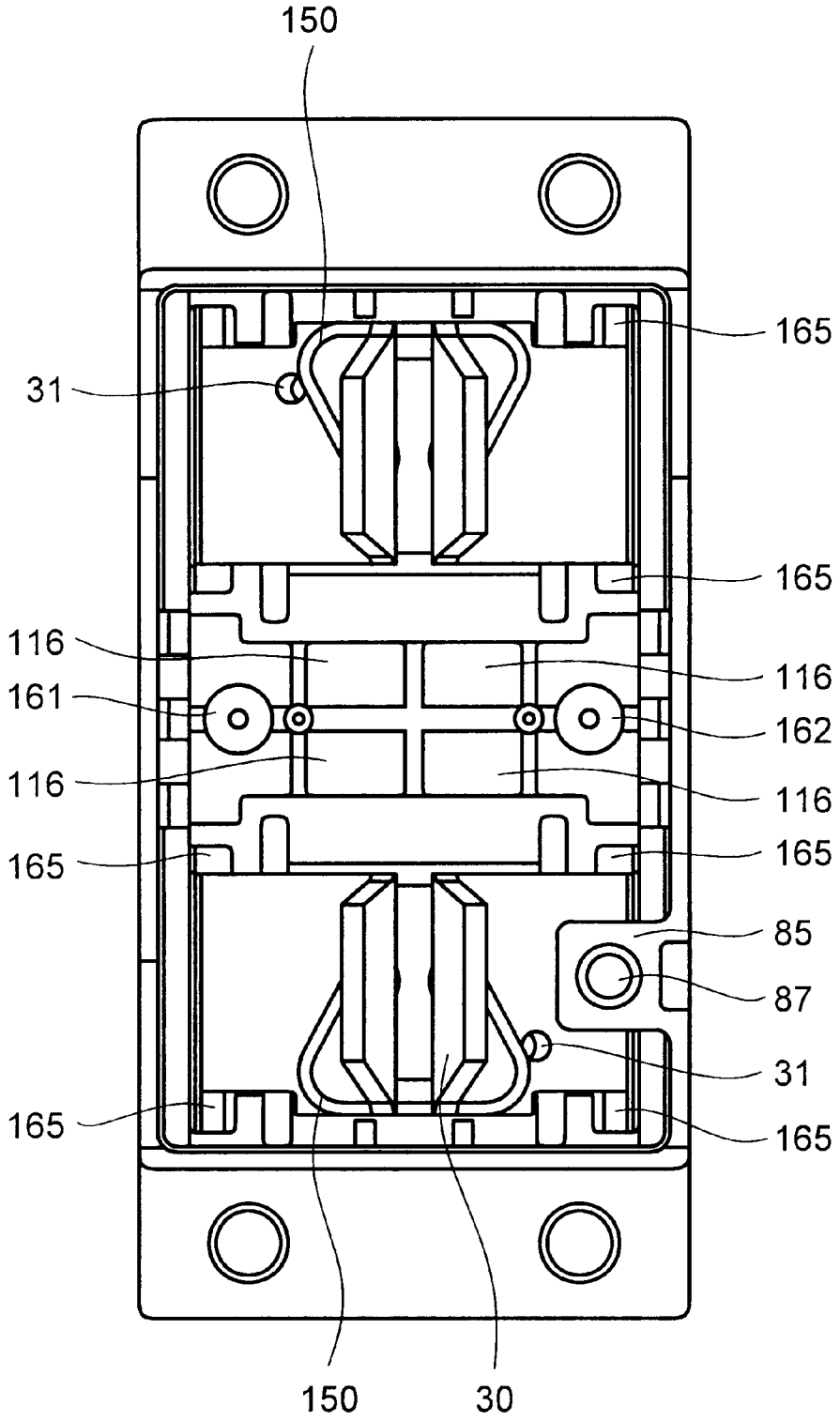
FIG. 4 is a top view of the base of the switch of FIG. 1.

As best illustrated in FIGS. 1, 3, and 4, base 15 is also a rectangular member that receives the top 20. The base 15 can be formed of any suitable nonconductive material. Preferably, the material is a moldable plastic. The base 15 includes a plurality of vent openings 115 disposed on opposing sides of the base 15. Three vent openings 115 are illustrated, for example, in FIG. 1.

Figure 9:
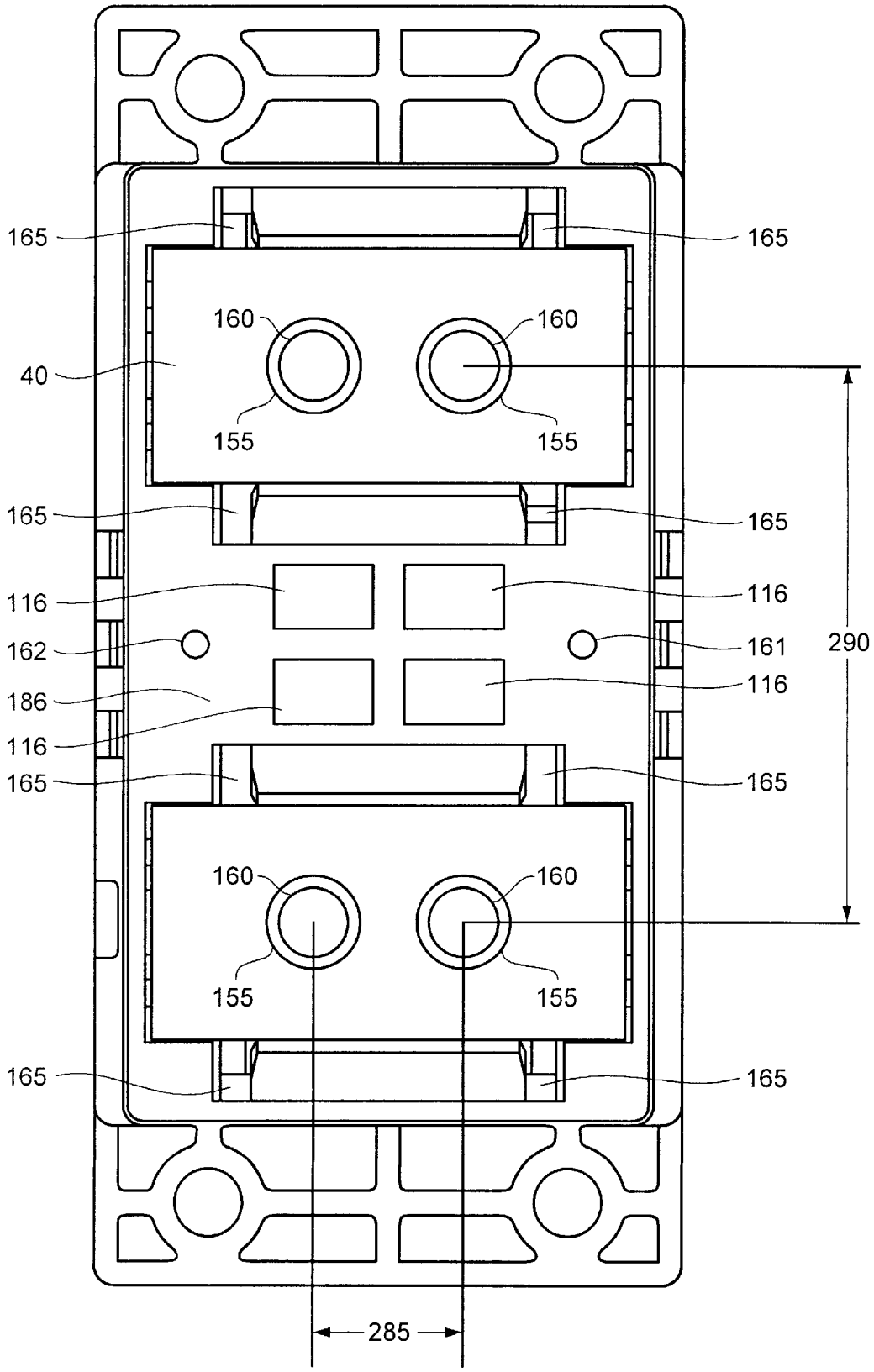
FIG. 9 is a bottom view of the switch of FIG. 1.
Figure 10:
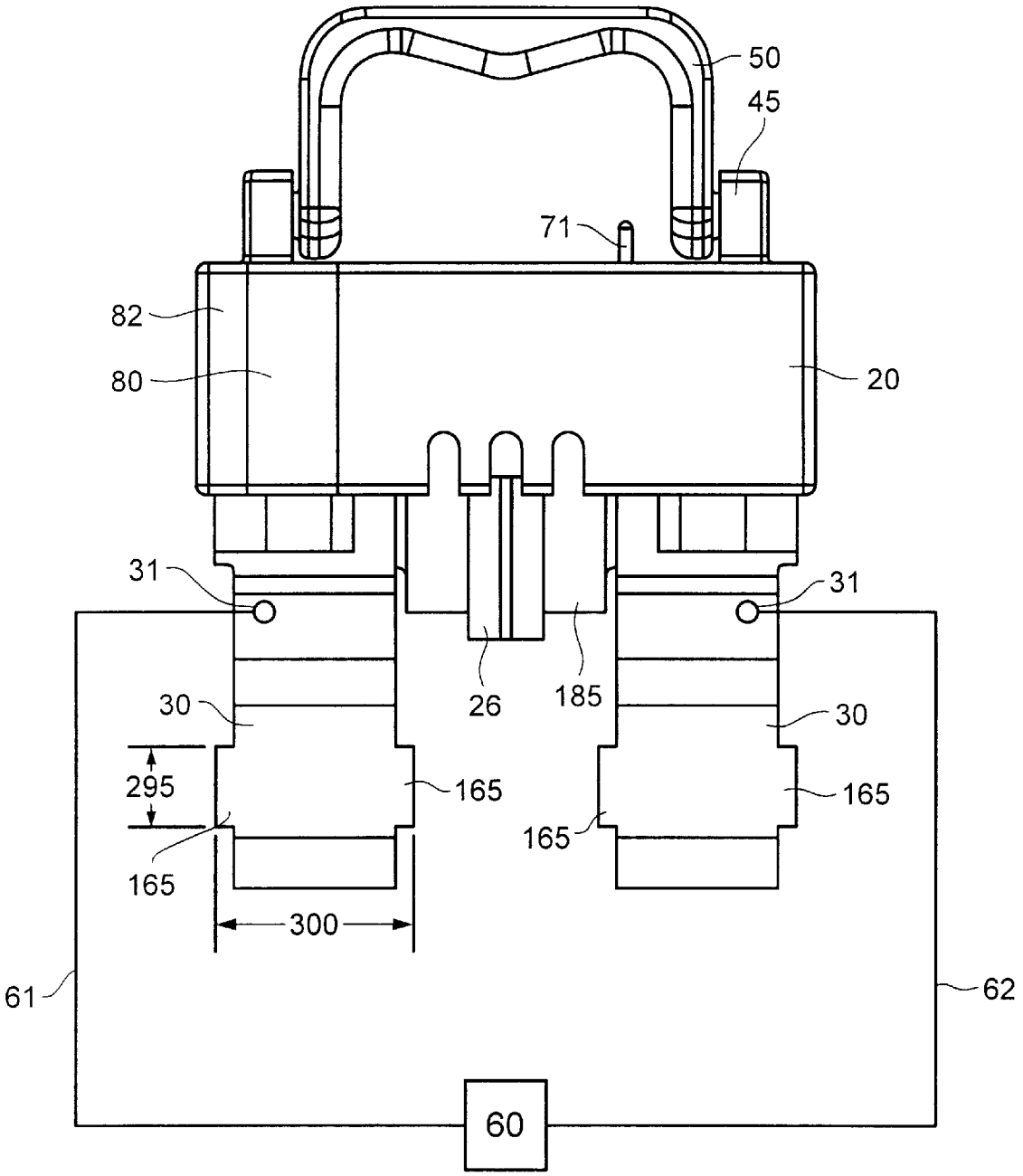
FIG. 10 is a side view of the components of the switch shown in FIG. 2.

The base 15 may also include a plurality of vent openings 116 disposed in the bottom of the base. Four of such openings are shown in FIGS. 4 and 9. The vent openings 116 also function as coring openings during molding of the base 15.

The base 15 may include mounting flanges 120 projecting from a vertical exterior end surface 121 of the base 15. These mounting flanges 120 can have mounting apertures 122 which allow fasteners, such as bolts or screws, to pass therethrough.

Figure 5:
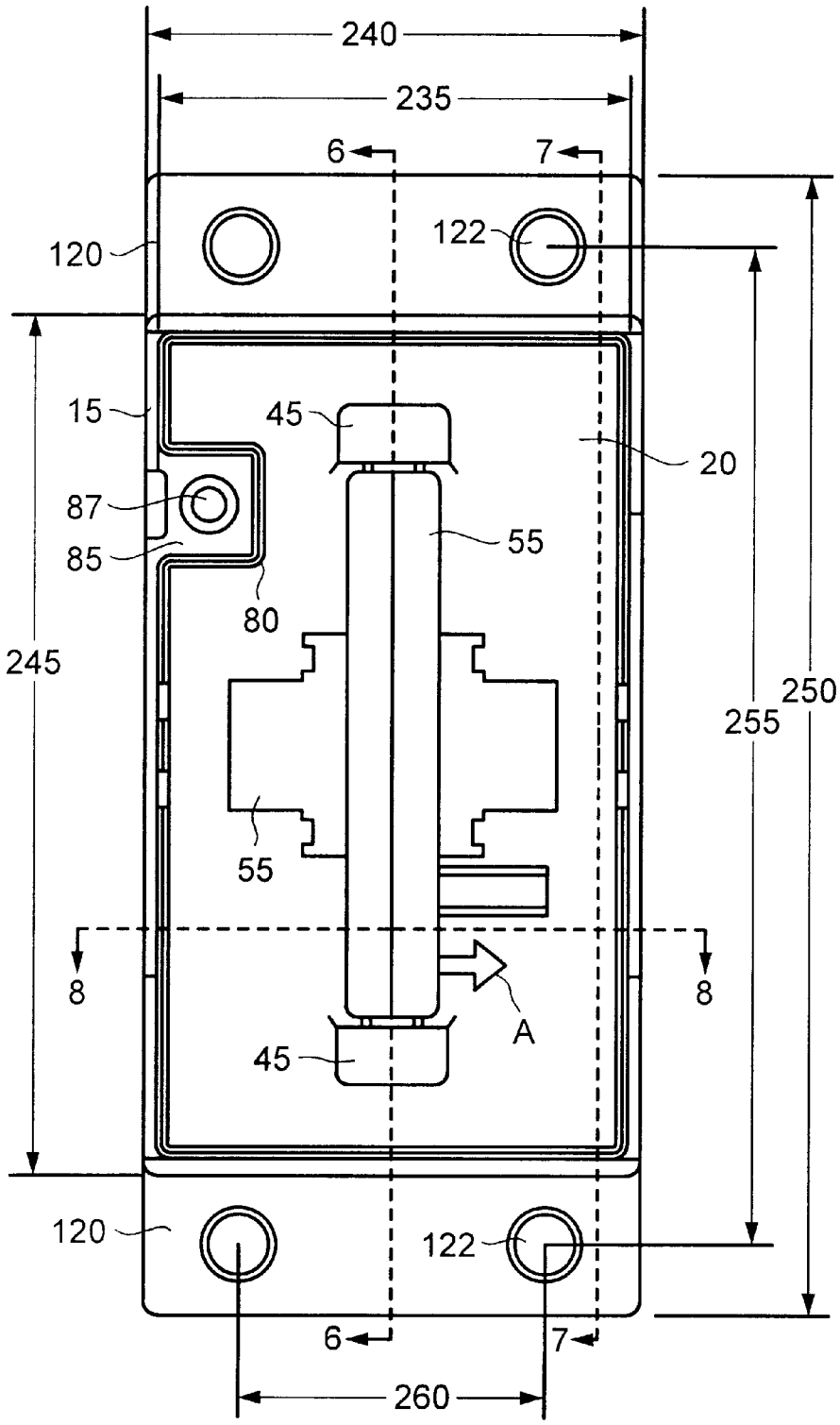
FIG. 5 is a top view of the switch of FIG. 1.

As illustrated best in FIGS. 1, 3, and 5, base 15 may have a guide projection 85 that is matingly received by mounting slot 80 in the top 20. Therefore, correct assembly of the top 20 within the base 15 is assured. Guide projection 85 also functions as a housing for an indicator, such as an LED, that is visible through aperture 87. As will be explained later in more detail, this indicator light provides a way of locally indicating a blown fuse.

Figure 8:
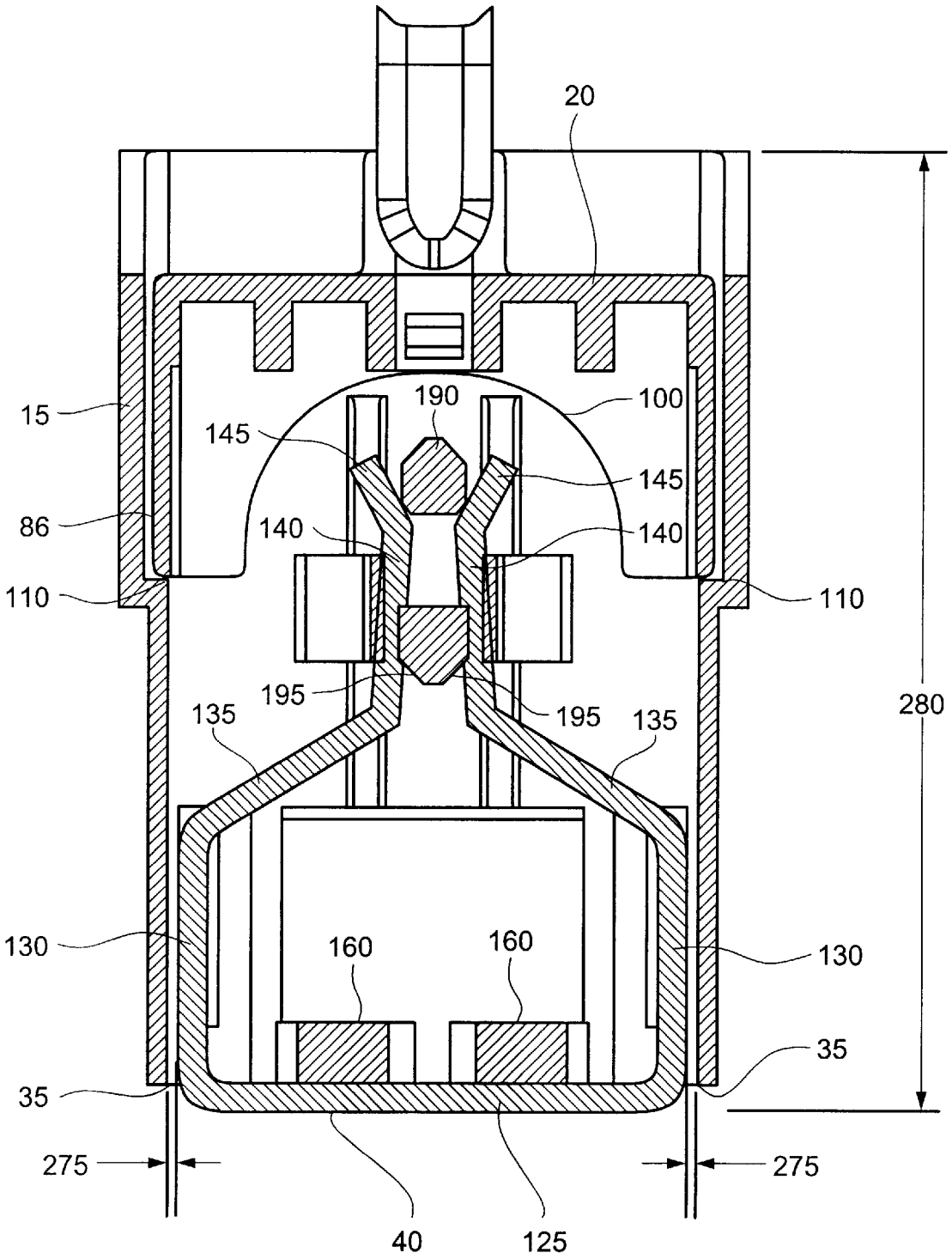
FIG. 8 is a cross-sectional view taken along line 8—8 of FIG. 5.

The interior of the base 15 has a first ledge 110 disposed along a first vertical interior surface 86 (see FIGS. 1 and 8). The ledge 110 is located such that top 20 rests upon ledge 110 when fully inserted into the base 15. At least one second ledge 170 is disposed along a second vertical interior surface 171. The second ledge 170 is located such that a fuse clip 30 rests thereon when mounted within the base 15.

As shown in FIG. 9, the bottom of the base 15 includes apertures 35 that allow exposure of a bottom surface 40 of the fuse clips 30 through the bottom of the base 15. A plurality of screw bosses 161 and 162 may also be provided in the bottom of the base 15 in order to permit connection of a separate component to the switch, such as an alarm circuit board (not shown).

Figure 2:
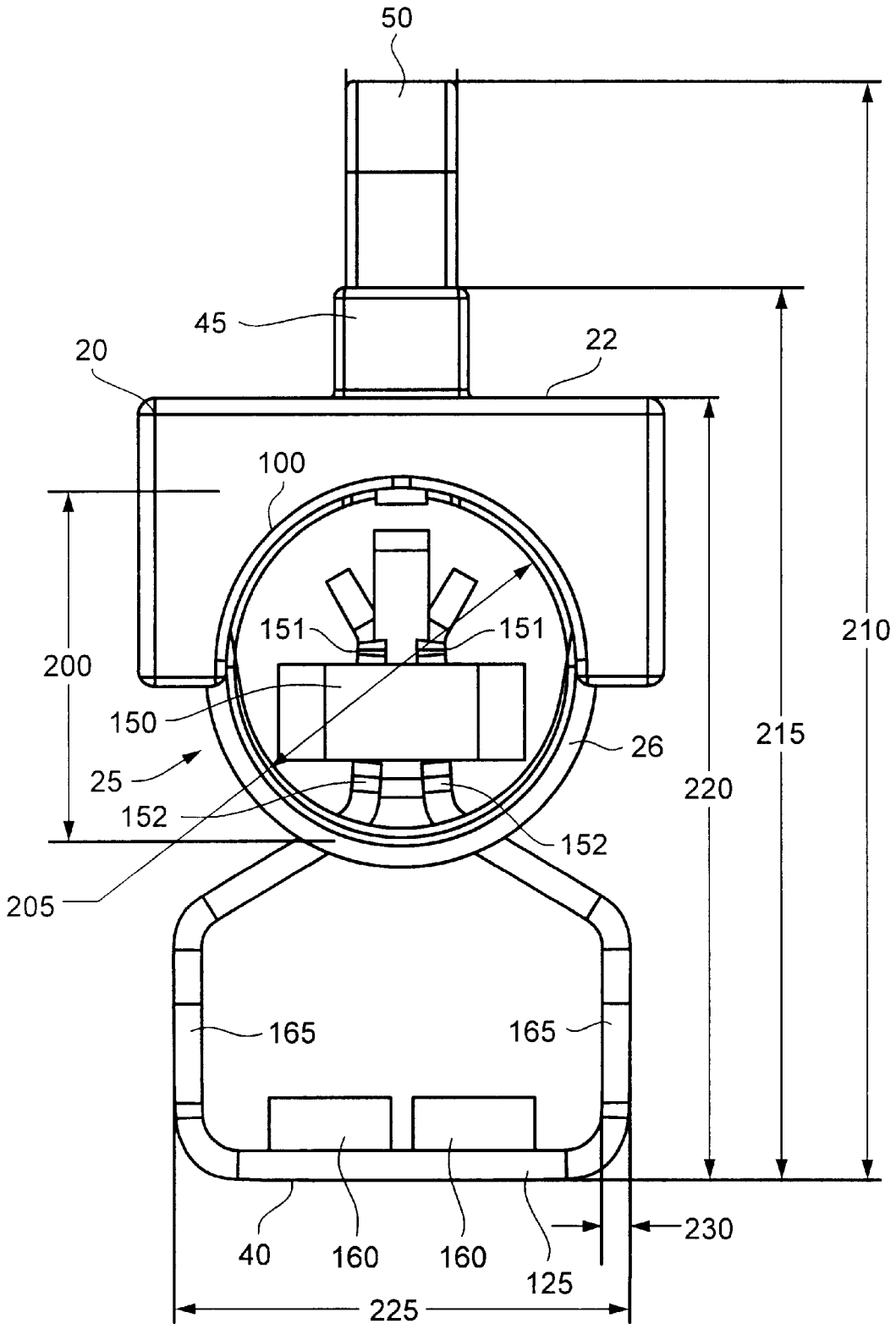
FIG. 2 is an end view of the top, fuse, and spring clip of the switch of FIG. 1, absent the base.

A plurality of fuse clips 30 are mounted within the base 15. Fuse clips 30 are formed from any suitable electrically conductive metal. The construction of the fuse clips 30 is best illustrated in FIGS. 1, 2, and 8. Each of the fuse clips 30 has a flat horizontal base 125, a pair of first vertical sections 130 extending from opposite ends of the base 125, a pair of first oblique sections 135 extending from the first vertical sections 130, a pair of second vertical sections 140 extending from the first oblique sections 135, and a pair of second oblique sections 145 extending from the second vertical sections 140. A plurality of holes 31 are provided in the fuse clips 30 in order to permit electrical connection thereto. The purpose of this electrical connection is discussed in more detail below.

When a fuse 180 is inserted into the fuse clips 30, a lower surface of a blade-type terminal 190 first engages the second oblique sections 145 which act like ramping surfaces that push these sections 145 away from each other. The blade-type terminal 190 next engages the second vertical sections 140. As illustrated in FIG. 9, when the fuse 180 is fully inserted into the fuse clips 30, a lower portion of each blade 190 is in engagement with second vertical sections 140, while an upper portion of each blade 190 is in engagement with the second oblique sections 145.

Spring clips 150 may be utilized to more securely retain the blade-type terminals 190 within the fuse clips 30. As illustrated in FIGS. 1 and 2, the spring clips 150 may be precisely held in their proper positions by providing a plurality of upper locating projections 151 and a plurality of lower locating projections 152 disposed on the fuse clips 30.

Fuse clips 30 are provided with a plurality of apertures 155 that extend through the bottom surface 40 and through the horizontal base 125, as best illustrated in FIG. 9. A threaded grommet 160 may be received in each aperture 155. The threaded grommets 160 are adapted to receive threaded male connectors (not shown) which connect the switch 10 to a circuit (not shown). By this construction a site for electrical connection is provided directly at the bottom surface 40 of the horizontal base 125 of the fuse clips 30. This construction helps provide a compact overall package size and eliminates the need for added terminal formations which are common in the conventional art. By eliminating unnecessary terminal members and connecting elements, the present invention exhibits lower electrical resistance and associated lower operating temperatures, as well as lower voltage drops (or watt losses).

The fuse clips 30 are retained within the base 15 by engagement of the horizontal base 125 with retaining flanges 175. As illustrated in FIG. 6, these retaining flanges 175 may be integrally formed with the base 15.

The ability to locally and remotely indicate the status of the fuse 180 within the switch 10 is another aspect of the present invention. Local indication is provided by an LED 65 illustrated in FIG. 9, which is visible through aperture 87 in the base 15. Remote indication is provided by a remote monitoring apparatus 60 that is electrically connected to the switch 10 via leads 61 and 62 that are attached to the fuse clips at holes 31. This arrangement is schematically illustrated in FIG. 9.

Figure 11:
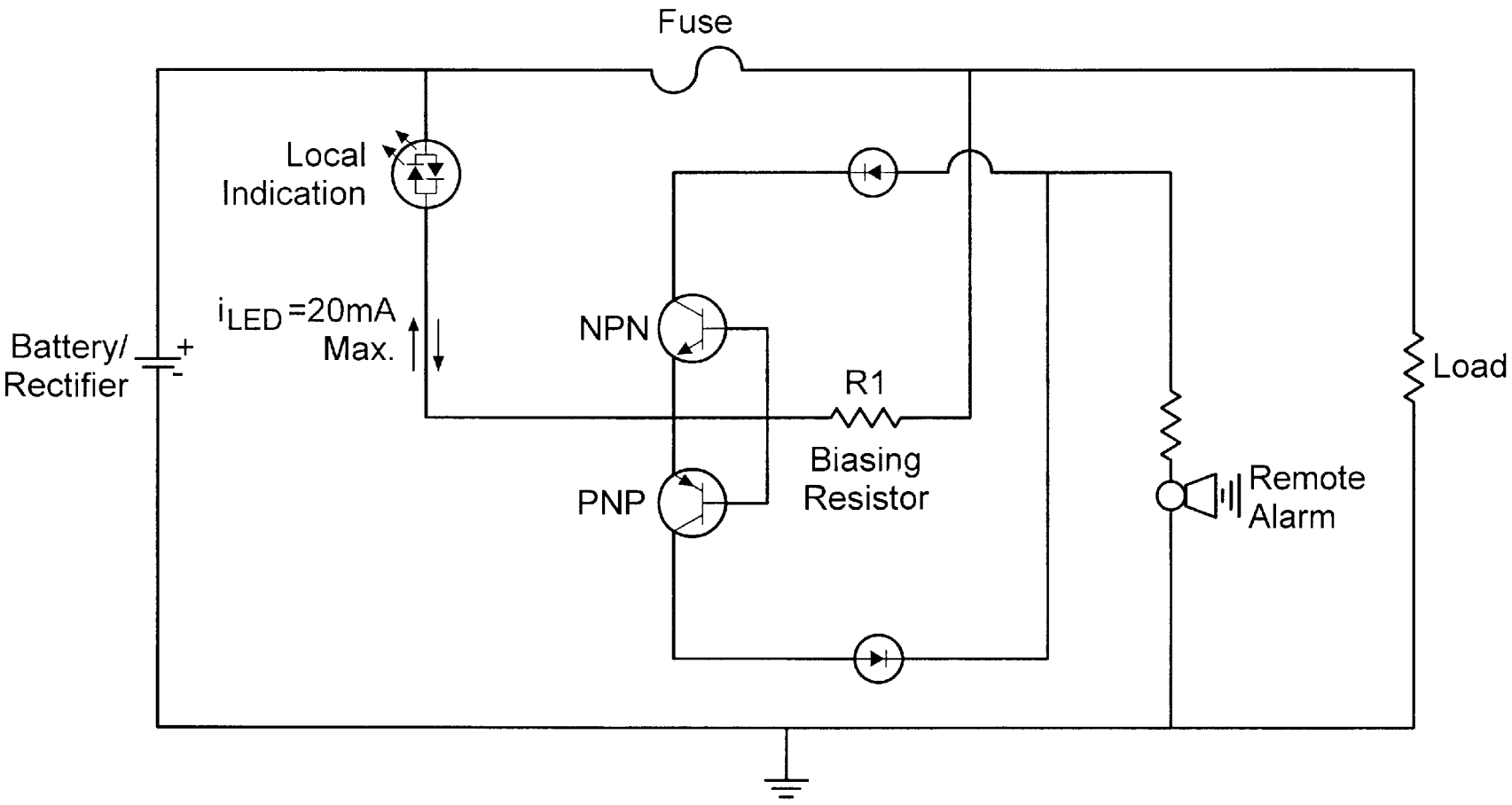
FIG. 11 is a schematic view of an alarm circuit for indicating a blown fuse according to the present invention.

An alarm circuit can be utilized to provide the desired indication. One example of such a circuit is shown in FIG. 11. The alarm circuit is designed to operate within a voltage range of −80 to +80 Vdc. A matched pair of BJT transistors, NPN and PNP, are used so that the circuitry can function under either a positive or negative system polarity. When an unblown fuse is operating in the circuit, there is a negligible voltage drop across the fuse. In this state the transistors are "off" and the alarm circuitry is inactive. However, when a fuse "blows", a voltage drop equivalent to the system voltage appears across the fuse. This voltage drop is transmitted to the monitoring device 60 by the leads 61 and 62, and causes one of the transistors (depending upon system polarity) to enter into saturation and switch "on" the alarm circuit indication device(s). The resulting alarm signal is transmitted to a remote indicator. At least one one-quarter inch "quick connection" 186 can be used for transmission of the remote alarm output via a suitable connector. As illustrated in FIG. 9, the quick connection(s) 186 is (are) accessible through openings 116. In connection with the above-mentioned circuit, it should be noted that the biasing resistor R1 can be rated at appropriately 330K ohms. Also, as previously noted, the polarity of the battery/rectifier may be the reverse of that illustrated in FIG. 11.

It should be apparent that the specific dimensions of the switch 10 can vary according to the particular application. Various dimensions are shown in FIGS. 2, 5, 6, 8, and 9, and are given below by way of example:

| Reference | Description | size(mm/in.) |
|---|---|---|
| 200 | Inner diameter of the fuse retaining ring 26 | 39.12/1.540 |
| 205 | Radius of curvature of retaining ring 26 | 38.10/1.500 |
| 210 | Vertical distance between top of handle 50 and bottom surface 40 of base 125 of the clip 30 | 123.32/4.588 |
| 215 | Vertical distance between top of hinge 45 and bottom surface 40 of base 125 of the clip 30 | 100.20/3.945 |
| 220 | Vertical distance between horizontal planar surface 22 and bottom surface 40 of base 125 of fuse clip 30 | 87.50/3.445 |
| 225 | Horizontal width of fuse clip 30 as defined by distance between first vertical portions 130 | 52.96/2.085 |
| 230 | Thickness of fuse clip 30 | 3.18/.125 |
| 235 | Horizontal Depth of base 20 | 60.33/2.375 |
| 240 | Horizontal Dept of base 15 | 66.42/2.615 |
| 245 | Horizontal width of opening in base 15 | 99.06/3.900 |
| 250 | Horizontal distance between ends of mounting projections 120 | 139.70/5.500 |
| 255 | Distance between center of apertures 122 on opposite sides of the base 15 | 122.43/4.820 |
| 260 | Distance between apertures 122 on the same side of the base 15 | 41.20/1.615 |
| 265 | Horizontal width of bottom of the base 15 | 105.16/4.140 |
| 270 | Vertical Dimension of retaining flanges 175 | 23.621/.930 |
| 275 | Clearance between fuse clips 30 and the interior surface of | .70/.028 |

-continued

| Reference | Description | size(mm/in.) |
|---|---|---|
| | the base 15 | |
| 280 | Maximum vertical height of the base 15 | 100.20/3.945 |
| 285 | Distance between center of apertures 155 on same fuse clips 30 | 16.76/.660 |
| 290 | Distance between center of apertures 155 on opposing fuse clips 30 | 61.47/2.420 |
| 295 | Vertical dimension of locking projection 165 of fuse clip 30 | 11.18/.440 |
| 300 | Horizontal dimension of locking projection 165 of fuse clip 30 | 31.50/1.240 |

An example of how the switch 10 is intended to operate will now be described. The switch 10 is electrically connected to a circuit, such as a high-amp-hour battery string circuit, at surface 40 of the fuse clips 30. Electrical connection may be provided by matingly receiving a male threaded connector (not shown) within threaded grommets 160. The base 15 of the switch 10 can be mechanically secured by fasteners (not shown) passing through apertures 122. The top 20 carries the fuse 180 having male blade-type terminals 190 and is removably received within the base 15. Upon insertion of the top 20 into the base 15, the terminals 190 of the fuse 180 come into contact with the conductive fuse clips 30, thereby electrically connecting the fuse clips 30 and completing the circuit.

Once the top 20 is fully inserted into the base 15, the fuse 10 is in the "on" condition. The switch is turned "off" by grasping the handle 50 and separating the top 20 from the base 15. By doing so, the fuse 180 is also removed and the electrical connection between the fuse clips 30 is broken thereby interrupting the circuit.

The condition of the fuse 180 can be monitored locally and/or remotely. Local indication can be provided by an LED 65 mounted within the base 15. When the fuse 180 is blown the LED 65 may be activated by a transistor NPN or PNP that reacts to the voltage drop associated with the blown fuse 180. Similarly, a remote monitoring device 60 can be electrically connected to the base by leads 61 and 62 at holes 31. A remote alarm can be provided that is activated by a transistor NPN or PNP that reacts to the voltage drop resulting from a blown fuse 180 and is connected to the switch 10 through at least one one-quarter inch "quick connection" 186.

Only preferred embodiments are specifically illustrated and described herein. It should be appreciated that numerous modifications and variations of the present invention are possible in light of the disclosure, such modifications and variations being encompassed within the scope of the appended claims without departing from the spirit and scope of the present invention.

What is claimed is:

1. A pull-out fusible switch comprising:

an electrically nonconductive base;

an electrically nonconductive removable top, said top having a fuse carrier;

a fuse having a fuse body and blade-type terminals projecting from opposite ends of said fuse body, said fuse mounted within said fuse carrier;

at least one electrically conductive fuse clip mounted within said base; and said at least one fuse clip adapted to directly receive one of said blade-type terminals.

2. The switch of claim 1, wherein said top includes a clear window which permits visual observation of said fuse.

3. The switch of claim 1, wherein a local monitoring device is electrically connected to said switch.

4. The switch of claim 1, wherein a remote monitoring device is electrically connected to said switch.

5. The switch of claim 1, wherein:

local and remote monitoring devices are electrically connected to said switch;

said local and remote monitoring devices are connected to each other by an alarm circuit;

said local monitoring device including an LED;

said remote monitoring device including a remote alarm; and said LED and said remote alarm being activated by at least one transistor element in response to a voltage drop across said alarm circuit.

6. The switch of claim 1, wherein said top includes a release lever and retaining projection that releasably secures said fuse to said top.

7. The switch of claim 1, wherein said top includes a fuse retaining ring.

8. The switch of claim 1, wherein said top includes a guide slot disposed on an exterior surface of said top, and said base includes a guide projection disposed on an interior surface of said base that matingly engages said guide slot when said top is correctly inserted into said base.

9. The switch of claim 1, wherein said top includes a fuse terminal guide disposed on an interior surface of said top that is adapted to engage a terminal of said fuse.

10. The switch of claim 9, wherein said top includes an arcuate aperture in one side surface of said top, said fuse terminal guide is disposed on a side of said top opposite said one side having said arcuate aperture, whereby a fuse can be inserted only from said arcuate aperture side of said top.

11. The switch of claim 1, wherein said at least one fuse clip has a horizontal base;

a pair of first vertical sections, each extending from an opposite end of said horizontal base;

a pair of first oblique sections, each extending from one of said first vertical sections;

a pair of second vertical sections, each extending from one of said first oblique sections; and a pair of second oblique sections, each extending from one of said second vertical sections.

12. The switch of claim 1, wherein at least one spring clip is mounted to said fuse clip, said spring clip adapted to urge the fuse clip into firm engagement with one of said blade-type terminals.

13. The switch of claim 1, wherein said at least one fuse clip has a horizontal base, and a plurality of apertures disposed in said horizontal base.

14. The switch of claim 1, wherein said base includes a plurality of retaining flanges that engage a horizontal base of said at least one fuse clip, thereby retaining said at least one fuse clip within said base.

15. The switch of claim 1, wherein said base includes at least one aperture, a surface of said fuse clip being located in said aperture thereby providing a site for direct electrical connection.

16. The switch of claim 1, wherein said fuse is mounted within said fuse carrier such that by removing said top, at least one of said blade-type terminals are withdrawn from contact with said at least one fuse clip.

17. The switch of claim 1, wherein said top includes a member in engagement with an end surface of the fuse body thereby retaining said fuse within said top.

18. A pull-out fusible switch comprising:

an electrically nonconductive base having at least one aperture disposed therein;

an electrically nonconductive removable top, said top having a fuse carrier; and at least one electrically conductive fuse clip mounted within said at least one aperture, a surface of said fuse clip being located in said aperture thereby providing a site for direct electrical connection.

19. The switch of claim 18, wherein a fuse having a body and terminals is mounted within said fuse carrier.

20. The switch of claim 19, wherein said fuse body is cylindrical.

21. The switch of claim 20, wherein said terminals are blade-type members that extend from opposite ends of said fuse body.

22. The switch of claim 21, wherein said blade-type terminals are chamfered.

23. The switch of claim 18, wherein said removable top is adapted to be received within said aperture, said fuse carrier constructed to receive at least a body of a fusible element in a manner such that removal of said top from said aperture of said base also causes said fusible element to be removed from said base.

* * * * *

US005973418C1

(12) EX PARTE REEXAMINATION CERTIFICATE (5960th)

United States Patent
Ciesielka et al.

(10) Number: US 5,973,418 C1
(45) Certificate Issued: Oct. 23, 2007

(54) PULL-OUT HIGH CURRENT SWITCH

(75) Inventors: Sean V. Ciesielka, Mundelein, IL (US); B. Heath Scoggin, Wildwood, MO (US); Jaime A. Torrez, Chesterfield, MO (US)

(73) Assignee: Cooper Technologies Company, Houston, TX (US)

Reexamination Request:
No. 90/006,557, Mar. 3, 2003

Reexamination Certificate for:

| | |
|---|---|
| Patent No.: | **5,973,418** |
| Issued: | **Oct. 26, 1999** |
| Appl. No.: | **09/072,450** |
| Filed: | **May 5, 1998** |

(51) Int. Cl.
*H01H 35/00* (2006.01)

(52) U.S. Cl. ..... 307/130; 307/112; 307/116; 340/635; 340/660

(58) Field of Classification Search ..... None
See application file for complete search history.

(56) References Cited

U.S. PATENT DOCUMENTS 5,816,858 A * 10/1998 Kazarian et al. ..... 439/621

FOREIGN PATENT DOCUMENTS

| | | |
|---|---|---|
| DE | 1902605 | 10/1964 |
| DE | AS 1246848 | 8/1967 |
| DE | 43 08 691 A1 | 10/1993 |
| FR | 1013631 | 4/1952 |
| SE | 368308 | 6/1974 |
| WO | WO 86/06221 | 10/1986 |

OTHER PUBLICATIONS

Translation of French Patent 1,013,631.*

Translation of German Patent 43 08 691.*

Translation of German Patent 1 246 846.*

* cited by examiner

*Primary Examiner*—Margaret Rubin

(57) ABSTRACT

A high-current fusible switch includes a nonconductive base, a nonconductive removable top, a plurality of conductive fuse clips, and a fuse having blade-type terminals. The fuse clips are fixedly mounted within the base. The fuse is retained within the top. Switching is accomplished by inserting or removing the top so that the fuse completes or breaks the circuit to which the switch is connected. The switch is connected to the circuit directly at the fuse clips so that a compact design is achieved that eliminates undesirable multiple electrical contacts.

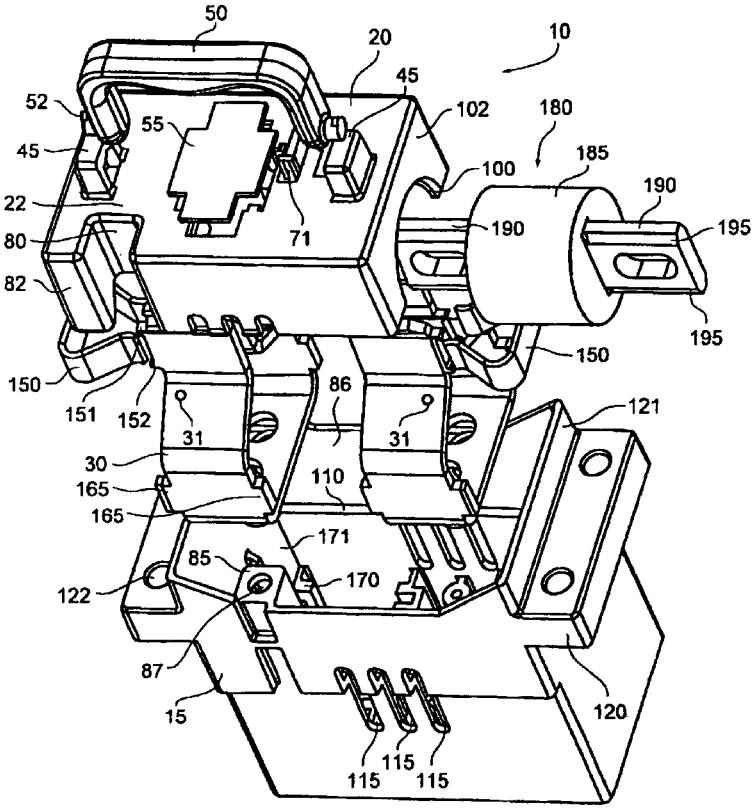

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, lines 15–27:

A switch constructed according to the principles of the present invention is shown generally at 10, and is best illustrated in FIGS. 1 and 3. The main components of the switch 10 include an electrically nonconductive base 15, an electrically nonconductive top 20, electrically conductive fuse clips 30, and a fuse 180. The top 20 is removably received 20 within the base 15. The fuse clips 30 are fixedly mounted within the base 15, and the fuse 180 is mounted within the top 20. The switch 10 is electrically connected to a circuit (not shown) via the fuse clips 30. As will be explained more [filly] *fully* below, the switch is "turned off", and the circuit is broken, by separating the top 20 (along with the fuse 180) from the base 15.

AS A RESULT OF REEXAMINATION, IT HAS BEEN DETERMINED THAT:

Claims 12 and 15 are cancelled.

Claims 1, 2, 7, 18, 19 and 23 are determined to be patentable as amended.

Claims 3–6, 8–11, 13–14, 16–17 and 20–22, dependent on an amended claim, are determined to be patentable.

New claims 24–29 are added and determined to be patentable.

1. A pull-out fusible switch comprising:

an electrically nonconductive base;

an electrically nonconductive removable top, said top having a fuse carrier;

a fuse having a fuse body and blade-type terminals projecting from opposite ends of said fuse body, said fuse mounted within said fuse carrier;

at least one electrically conductive fuse clip mounted within said base; [and]

said at least one fuse clip adapted to directly receive one of said blade-type terminals*;*

*at least one spring clip mounted to said at least one fuse clip, said spring clip adapted to urge the fuse clip into firm engagement with one of said blade-type terminals; and*

*wherein said base includes at least one aperture, a surface of said fuse clip being located in said aperture thereby providing a site for direct electrical connection.*

2. The switch of claim 1, wherein said top includes a [clear] window which permits visual observation of said fuse.

7. The switch of claim 1, wherein said top includes a *nonconductive* fuse retaining ring.

18. A pull-out fusible switch comprising:

an electrically nonconductive base having at least one aperture disposed therein;

an electrically nonconductive removable top, said top having a fuse carrier *and an opening adjacent said fuse carrier, thereby allowing visual inspection of a fuse through said opening*; and at least one electrically conductive fuse clip mounted within said at least one aperture, a surface of said fuse clip being located in said aperture thereby providing a site for direct electrical connection.

19. The switch of claim 18, wherein [a fuse having] *said fuse comprises* a body and terminals [is] mounted within said fuse carrier.

23. The switch of claim 18, wherein said removable top is adapted to be received within said aperture, said fuse carrier constructed to receive at least a body of [a fusible element] *said fuse* in a manner such that removal of said top from said aperture of said base also causes said [fusible element] *fuse* to be removed from said base.

*24. A pull-out fusible switch comprising:*

*an electrically nonconductive base;*

*an electrically nonconductive removable top, said top having a fuse carrier and said top includes a fuse retaining ring;*

*a fuse having a fuse body and blade-type terminals projecting from opposite ends of said fuse body, said fuse mounted within said fuse carrier;*

*at least one electrically conductive fuse clip mounted within said base;*

*said at least one fuse clip adapted to directly receive one of said blade-type terminals.*

*25. A pull-out fusible switch comprising:*

*an electrically nonconductive base;*

*an electrically nonconductive removable top, said top having a fuse carrier;*

*a fuse having a fuse body and blade-type terminals projecting from opposite ends of said fuse body, said fuse mounted within said fuse carrier;*

*at least one electrically conductive fuse clip mounted within said base;*

*said at least one fuse clip adapted to directly receive one of said blade-type terminals;*

*wherein said top includes a fuse terminal guide disposed on an interior surface of said top that is adapted to engage a terminal of said fuse and an arcuate aperture in one side surface of said top, said fuse terminal guide being disposed on a side of said top opposite said one side having said arcuate aperture, whereby a fuse can be inserted only from said arcuate aperture side of said top.*

*26. A pull-out fusible switch for interrupting high-current DC circuits comprising:*

*an electrically nonconductive base;*

*an electrically nonconductive removable top, said top having a fuse carrier;*

*a fuse having a fuse body and blade-type terminals projecting from opposite ends of said fuse body, said fuse mounted within said fuse carrier and removable therefrom by hand and without the use of tools;*

*first and second conductive fuse clips mounted within said base;*

*said at least one fuse clip adpated to directly receive one of said blade-type terminals when said top is engaged to said base, thereby completing a high-current DC circuit between the first and second fuse clips and said fuse.*

*27. A pull-out fusible switch comprising:*

*an electrically nonconductive base having at least one aperture disposed therein;*

*an electrically nonconductive removable top, said top having a fuse carrier; and*

*at least one electrically conductive fuse clip mounted within said at least one aperture and configured to complete a high-current DC circuit when a fuse is coupled to said carrier and when said top is engaged to said base, a surface of said fuse clip being located in said aperture thereby providing a site for direct electrical connection to the high current DC circuit, said high-current DC circuit being broken via extraction of said top from said base.*

*28. A pull-out fusible switch comprising:*

*an electrically nonconductive base;*

*an electrically nonconductive removable top, said top having a fuse carrier;*

*a fuse having a fuse body and blade-type terminals projecting from opposite ends of said fuse body, said fuse mounted within said fuse carrier;*

*at least one electrically conductive fuse clip mounted within said base;*

*said at least one fuse clip adapted to directly receive one of said blade-type terminals and configured to complete a high-current DC circuit through said fuse when said top is engaged to said body, and configured to break the high-current DC circuit through said fuse when said top is removed from said body.*

*29. A pull-out fusible switch comprising:*

*an electrically nonconductive base;*

*an electrically nonconductive removable top, said top having a fuse carrier;*

*a fuse having a fuse body and blade-type terminals projecting from opposite ends of said fuse body, said fuse mounted within said fuse carrier;*

*at least one electrically conductive fuse clip mounted within said base;*

*said at least one fuse clip adapted to directly receive one of said blade-type terminals;*

*a remote monitoring device attached to said at least one fuse clip, said remote monitoring device responsive to a voltage drop across said fuse when a high current DC circuit is completed through said fuse through said at least one fuse clip; and*

*a local monitoring device mounted within said base, said local monitoring device visually indicating an operating state of said fuse when the high current DC circuit is completed.*

* * * * *